United States Patent [19]

Steinemer

[11] Patent Number: 4,550,234

[45] Date of Patent: Oct. 29, 1985

[54] VACUUM CIRCUIT BREAKER WITH TWO SWITCHING TUBES CONNECTED IN SERIES FOR EACH POLE

[75] Inventor: Norbert Steinemer, Berlin, Fed. Rep. of Germany

[73] Assignee: Siemens Aktiengesellschaft, Munich and Berlin, Fed. Rep. of Germany

[21] Appl. No.: 568,543

[22] Filed: Jan. 5, 1984

[30] Foreign Application Priority Data

Jan. 12, 1983 [DE] Fed. Rep. of Germany ..... 3300979

[51] Int. Cl.[4] ..... H01H 33/66

[52] U.S. Cl. ..... 200/144 B; 200/148 D; 200/148 F; 200/153 G; 200/153 K

[58] Field of Search ..... 200/144 B, 148 D, 148 F, 200/145, 153 G, 153 K

[56] References Cited

U.S. PATENT DOCUMENTS

| | | | |
|---|---|---|---|
| 2,783,338 | 2/1957 | Beatty | 200/148 D |
| 3,482,069 | 12/1969 | Badey et al. | 200/148 |
| 3,597,556 | 8/1971 | Sharp | 200/144 |
| 3,728,508 | 4/1973 | Netzel | 200/153 |
| 3,852,548 | 12/1974 | Goodwin, Jr. | 200/148 |
| 3,922,512 | 11/1975 | Benham | 200/148 D |
| 4,323,743 | 4/1982 | Peek | 200/148 D |
| 4,423,298 | 12/1983 | Tsukushi et al. | 200/145 |

FOREIGN PATENT DOCUMENTS

| | | | |
|---|---|---|---|
| 937821 | 3/1948 | France | 200/148 D |
| 1403216 | 5/1965 | France | 200/148 D |
| 477081 | 9/1969 | Switzerland | 200/148 F |
| 460909 | 10/1978 | Switzerland | 200/144 B |
| 960405 | 6/1964 | United Kingdom | 200/148 D |

OTHER PUBLICATIONS

"Vacuum Circuit-Breakers for 25 kV Trackside Supply", Electrical Review, Apr. 1973 at pp. 531 to 533.

"The System of Electrical Power Supply for 25 kV A.C. Electrification on British Railways", by Howard (Elektrische Bahnen 78, 1980, vol. 8, at pp. 198 to 202.

Meidensha Electrical Mfg. Co., Ltd. Catalog No. GB64-1949.

*Primary Examiner*—Robert S. Macon

*Attorney, Agent, or Firm*—F. W. Powers; J. L. James

[57] ABSTRACT

A vacuum circuit breaker (1) having two switching tubes (5) which are electrically connected in series and aligned coaxially. By means of an offset drive unit (toggle lever system 26) two motions that are contrary to one another are produced for the drive tappets (15) of the breaker tubes (5), from the common drive motion of a rod (11). The contact pressure springs (32) of the two switching tubes (5) are directly or indirectly connected to a common stationary support (35) which can be unfastened and moved to a new position. Simultaneous contacting or separation of the breaker elements of the two breaker tubes produced by the common drive is ensured by loosening the bearing block, after releasing the connection with the common drive mechanism, and fastening it again after the force differential has been automatically compensated for. The invention is suitable for vacuum circuit breakers in the medium-voltage range, such as those used to supply power to railroads.

13 Claims, 6 Drawing Figures

VACUUM CIRCUIT BREAKER WITH TWO SWITCHING TUBES CONNECTED IN SERIES FOR EACH POLE

BACKGROUND OF THE INVENTION

The invention relates to a vacuum circuit breaker with two switching tubes for each pole, which are electrically connected in series and arranged substantially coaxial. The circuit breaker includes an actuating device that is common to both tubes for closing and breaking the circuit. It also includes an offsetting drive mechanism to produce two motions that are contrary to one another with respect to a uniform drive motion, and a contact pressure spring assigned to each switching tube.

A vacuum circuit breaker of this type is described, for example, in the periodical Electrical Review, Apr. 13, 1973, at pages 531 to 533 and in the periodical Elektrische Bahnen 78 (1980), Volume 8, at pages 198 to 202. Further examples of vacuum circuit breakers of this kind are found in Catalogue GB64/1949 for vacuum circuit breaker Model VT-123 manufactured by the Meidensha Co. and in U.S. Pat. No. 3,597,556.

In vacuum circuit breakers with switching tubes that are connected in series and arranged coaxially, the contacts must open and close simultaneously to avoid overloading of one of the two switching tubes due to the breaker current. This can be achieved by adjustment of the coupling elements that are usually provided at the drive tappets of the switching tubes. This process, however, is tedious and very difficult to perform without errors.

SUMMARY OF THE INVENTION

It is therefore an object of the present invention to provide an adjustment mechanism for the switching tubes that is both simple to operate and relatively free from error. This is accomplished, for the type of vacuum circuit breaker previously described, by means of the following features:

(a) both contact pressure springs have a common support mounted with freedom to move along their line of action: and (b) a lever system connected with the free end of each contact pressure spring, and with the offset drive unit, for transmitting the force of the spring to the drive tappet of each switching tube.

This arrangement provides automatic compensation for errors resulting from manufacturing and from wear caused by the simultaneous activation of the switching tubes. To effect this compensation the fastening elements of the common support of the contact pressure springs are loosened and the lever system is separated from the actuating mechanism. Under the influence of the ambient air pressure both switching tubes assume the closed position and the support casting moves into the correct median position. Then the support is again fastened in the neutral position, and the lever system is reconnected to the actuating mechanism. Both switching tubes will now open and close simultaneously during the circuit breaking operations.

The invention can be used advantageously with the type of vacuum circuit breaker described above in which the offset drive includes a toggle lever system and a drive rod connected to the toggle joint and moveable along its own length and in which the toggle levers transmit the motion of the drive rod with a deflection of approximately 90% from the path of motion to the drive tappets of the switching tubes which face one another. In such a vacuum circuit breaker it is advantageous if the lever system includes a two-arm lever for each switching tube whose point of rotation, located between the ends, is placed at the drive tappet of the switching tube, and whose ends are connected by means of a joint directly or indirectly with the offset drive unit and with the support respectively. This permits the common support of the contact pressure springs to be placed at an easily accessible location within the vacuum circuit breaker. In addition, this permits an arrangement in which either stationary or moving contact pressure springs can be selected for the construction of a vacuum circuit breaker, in which the offset drive unit is mounted on a pole end that supports the ends of the switching tubes nearest to the drive. In this case it is best if a design is used in which the support is also fastened to the pole end and has longitudinal holes extending in the line of action of the contact pressure springs through which fastening elements can be inserted, and the contact pressure springs are mounted in a row, more or less coaxially, between the ends of the two-armed levers that are furthest from the drive rod, with the block being placed between the contact pressure springs. Due to the separation of the contact springs from the drive tappets of the switching tubes, space is saved in the axial direction. As a result the switching tubes can be placed closer to one another.

The invention can also be used in a vacuum circuit breaker in which the contact pressure springs are inserted in the offset drive unit as described in U.S. Pat. No. 3,597,556. In this case the contact pressure springs can have one of their ends connected to the end of the two-armed lever that is closest to the drive rod, and the ends of the two-armed levers that are furthest from the drive rod can be mounted with joints at separate points on the support. The adjustment of the synchronization of the switching tubes is also accomplished in this case by releasing the drive rod and the support and refastening them.

A space-saving arrangement of the vacuum circuit breaker tubes, with relatively little distance between them, can be accomplished by having the two-armed levers bent at right angles in the opposite direction with regard to the points of rotation located on the drive tappets. In the type of circuit breaker with contact pressure springs that are inserted in the offset drive unit, it is also possible for the arms of the two-armed levers that are closest to the support to be used as guiding levers. In this case the bearing point is chosen so that the line connecting the points of rotation located on the support and on the drive tappet deviates only slightly from a position at a right angle to the line of action of the switching tubes when the circuit is opened and closed.

Other features and advantages of the present invention will become apparent from the following detailed description, and from the claims.

For a full understanding of the present invention, reference should now be made to the following detailed description and to the accompanying drawings.

BRIEF DESCRIPTION OF THE DRAWINGS

FIG. 2 shows the position when the circuit is open and FIG. 3 shows the position when the circuit is closed.

FIG. 5 shows the position when the circuit is open and FIG. 6 shows the position when the circuit is closed.

DETAILED DESCRIPTION

Figure 1:
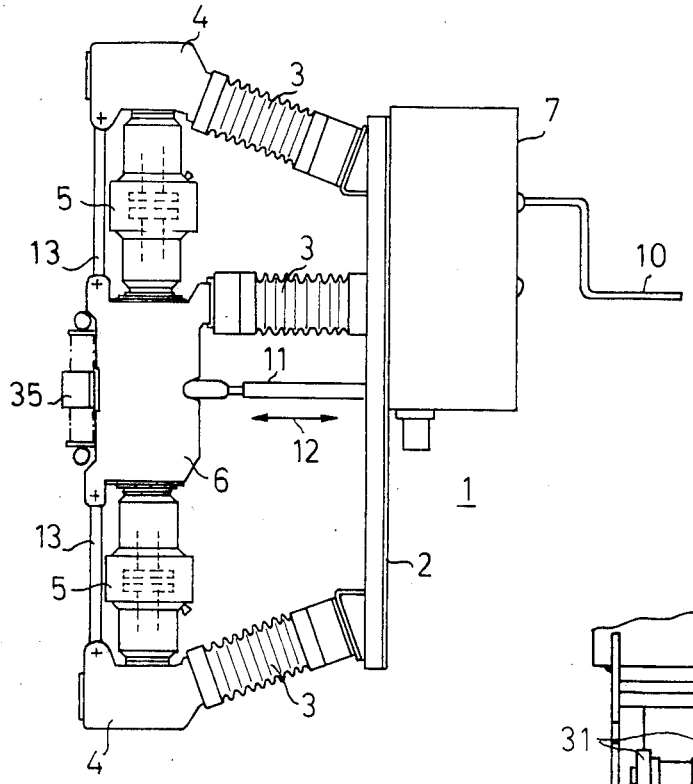
FIG. 1 shows a side view of a vacuum circuit breaker for the medium-voltage range.

Referring to FIG. 1, a vacuum circuit breaker is shown which is intended for use in the medium-voltage range and which is particularly suitable for supplying power to electrical railroads with single phase $16\frac{2}{3}$ Hz alternating current. This breaker includes vertical carrying plate 2 which is supported by three supporting insulators 3 fastened to the plate. The upper and lower supporting insulators each have headpiece 4, to which a switching tube 5 is fastened with its stationary connecting bolts. The two switching tubes 5 are aligned with one another, and pole end 6 located between them is connected to carrying plate 2 by the third supporting insulator 3. Drive chamber 7, fastened to carrying plate 2 on the side nearest the supporting insulators, contains all the parts necessary to generate and release the drive energy. The construction of actuating mechanism 7 is not described in great detail because mechanisms of this type are commonly known in various designs. For example, an actuating mechanism intended for use in vacuum circuit breakers is described in U.S. Pat. No. 4,152,562.

Figure 2:
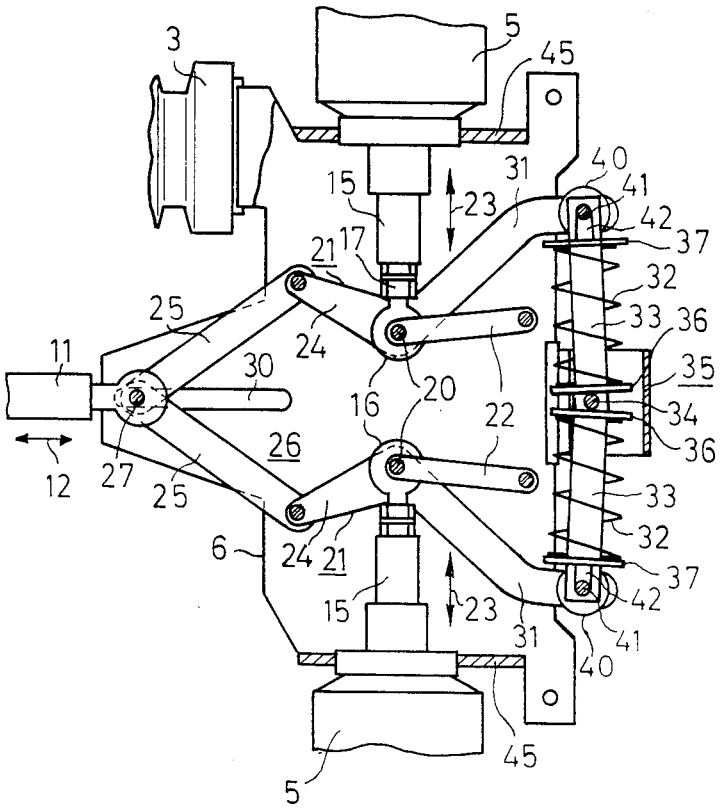
FIGS. 2 and 3 show details of the drive for the switching tubes, including a side view of the contact pressure springs.

To understand the method of operation, it must be stated that actuating mechanism 7 has hand crank 10, that is used to load a power storage unit which is then released to close the circuit by means of a release command. Insulating rod 11 then executes a more or less straight motion directed toward pole end 6, while the break the circuit it moves in the opposite direction, which is, in the direction of actuating mechanism 7 (double arrow 12). Referring to FIG. 1, insulating braces 13 are mounted in each case between pole end 6 and headpieces 4, which, in addition to supporting insulators 3, absorb a portion of the forces generated in the process of opening and closing the circuit. In FIG. 2, pole end 6 is shown with the adjacent parts of switching tubes 5 in the open circuit position. Each switching tube 5 possesses a drive tappet 15 which can be moved in an axial direction, and in which eyebolt 16 is inserted and fastened by means of nut 17. On one side of bearing pin 20, which passes through the head of each of the eyebolts, lever 21 with a double bend, is mounted and on the other side guiding lever 22 is mounted. During the motion of drive tappets 15 in the direction shown by double arrow 23 (which is necessary to open and close the circuit) the guiding levers ensure that the motion is guided so that any stress on the guide bearings (not shown in FIG. 2) of drive tappets 15 due to oblique forces, is as small as possible. Shorter arm 24, of each two-armed lever 21, is connected by means of a joint to one lever 25 of toggle lever system 26, and the respective joint bolt is fastened to drive rod 11. Drive rod 11 and toggle joint bolt 27 are guided in a straight line by means of lengthwise slot 30 located in sections of the walls of pole end 6.

Figure 4:
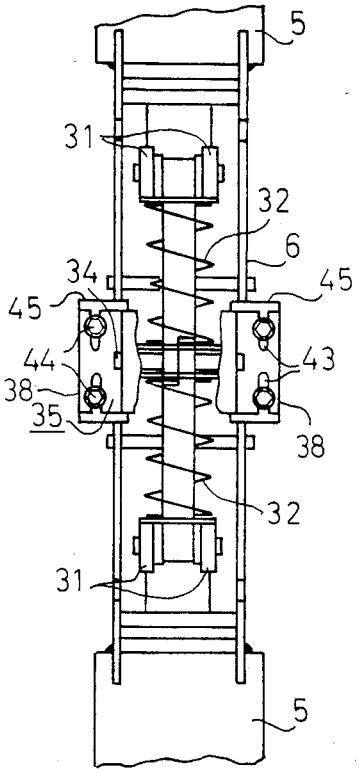
FIG. 4 shows a front view of the drive elements, including the fastening of the support casting for the contact pressure springs.

Longer arm 31 of each two-armed lever 21 works in combination with respective contact pressure springs 32. Contact springs 32 are designed as compression springs in which the windings surround respective guide rods 33, and whose inner ends rest on a common bearing pin 34. This pin is a part of block 35, which is roughly in the form of a U-shaped bracket with side arms that are bent outward (shown in FIG. 4). To support the respective inner ends of contact pressure springs 32, washer 36 is placed on bolt 34. For the outer ends of contact pressure springs 32 another washer 37 is provided in each case for transferring the force of the spring through respective rollers 40 and joint pins 41 that pass through them to arm 31 of two-armed lever 21. Each joint pins 41 passes through slot 42 located in the outer end of each guide rod 33.

Side arms 38 of support casting 35 are provided with slots 43 that are open at its edges and through which screws 44 are inserted. The ends of side arms 38 of support 35 rest in projections 45 of pole end 6. As has been shown, slots 43 run parallel to the longitudinal axis of contact pressure springs 32 (shown in FIG. 4). After fastening screws 44 have been loosened, support 35 moves accordingly, under the influence of a force differential, into a neutral position.

In the position assumed by the vacuum circuit breaker when the circuit is open (shown in FIG. 2) contact pressure springs 32 with their guide rods 33 are at an angle to one another that deviates only slightly from straight alignment. Toggle joint bolts 27 of toggle lever system 26 are in this case close to the left end of slot 30. If, from this starting point, drive rod 11 is moved to the right by drive mechanism 7 (shown in FIG. 1) then toggle lever system 26 acts as a reversing unit and effects a simultaneous movement of both drive tappets 15 in a direction that tends to close the circuit. These movements are roughly perpendicular to the longitudinal direction and to the path of drive rod 11. In this case the lever system consisting of two-armed levers 21 and guiding levers 22 is activated. This system transfers the drive motion to drive tappets 15, and it generates a defined contact force by means of contact pressure springs 32. This results in the closed-circuit position shown in FIG. 3. In this position toggle levers 25 have come very close to their full extension and toggle joint bolt 20 is accordingly close to the right end of slot 30. Contact pressure springs 32 are compressed, and, due to the swiveling of two-armed levers 21, their axes are inclined slightly toward one another in the opposite direction to that shown in FIG. 2.

The simultaneous contacting and separating of the breaker elements of switching tubes 5, during the breaking process that is essential for the operation of vacuum circuit breaker 1, is achieved in the following manner: First toggle lever system 26 is separated from actuating mechanism 7, for example, by releasing drive rod 11 at mechanism 7 or at toggle joint bolt 27. In addition, screws 44 of support 35 are loosened. Switching tubes 5 now assume the closed-circuit position under the influence of the ambient air pressure. Support 35 then moves, under the influence of the ambient air pressure. Support 35 then moves, under the influence of any existing force differential, into a neutral position which corresponds to the closed-circuit position of switching tubes 5. If fastening screws 44 are now tightened, it insures that in the course of the subsequent breakings and reclosings of the circuit the breaker elements will be simultaneously opened and closed by means of drive rod 11, the same mechanical and electrical stress will be produced each time. The procedure described here can be performed without the need for expensive auxiliary equipment or measuring devices. It can also be done rapidly because support 35 is easily accessible on the front side of pole end 6, as shown in FIG. 1. The decoupling of drive rod 11 from toggle lever system 26 or drive mechanism 7 can likewise be performed easily.

In the embodiment described above, two-armed levers 21 are connected directly by means of a joint to the offset drive unit (toggle lever system 26), while contact pressure springs 32 rest directly against support 35 and bolt 34 respectively.

Figure 5:
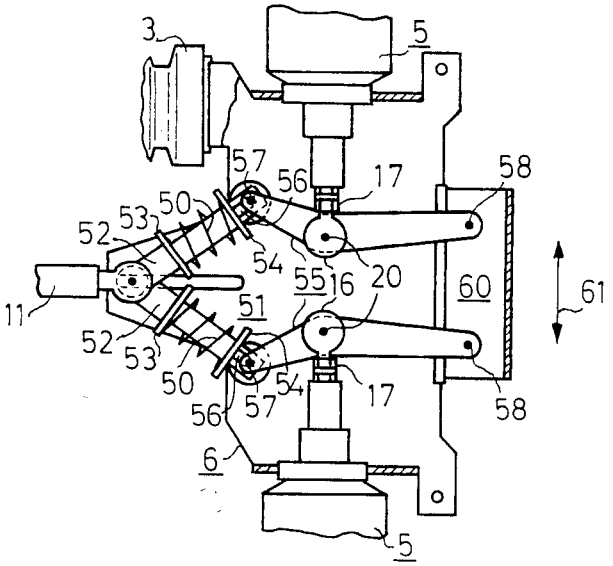
FIGS. 5 and 6 show another embodiment corresponding to FIGS. 2 and 3.
Figure 6:
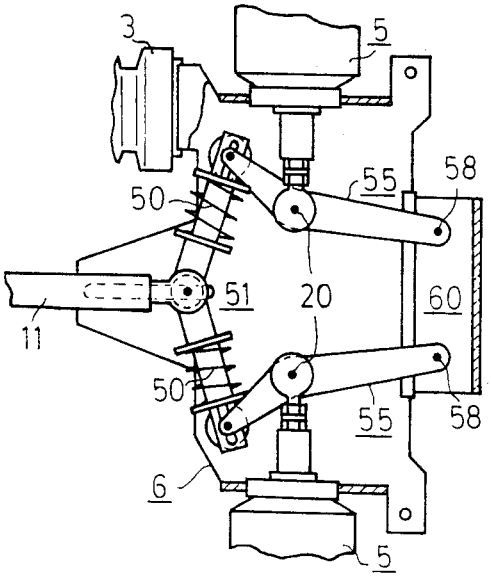

Referrng to FIG. 5 for the open-circuit position and to FIG. 6 for the closed-circuit position, another embodiment will now be described in which the contact pressure springs are connected to the support indirectly by inserting between two-armed levers 21 and the support other similar levers, while the two-armed levers themselves are connected indirectly, through the insertion of the contact pressure springs, with the offset drive unit. For the parts that are identical in these drawings the same reference numbers are used, to faciliate the comparison. This applies in particular to switching tubes 5, pole end 6, supporting insulator 3, drive rod 11, tappets 15, eyebolts 16 and nuts 17. Contact pressure springs 50 are compression springs which are located in toggle lever system 51 and are connected to drive rod 11. Each contact spring 51 is placed on toggle lever 52, on which it is supported by washer 53. The opposite ends of contact pressure springs 50 each rest on washer 54, which in turn transfers the force of the spring through a roller to two-armed lever 55. For this purpose, toggle levers 52 are each equipped with slot 56 through which bearing pin 57 is inserted into one end of each two-armed lever 55. As can be seen from a comparison of FIG. 5 with FIG. 6, contact pressure springs 50 are compressed when the circuit is closed; in which case the position of bearing pin 57 changes within slot 56.

Figure 3:
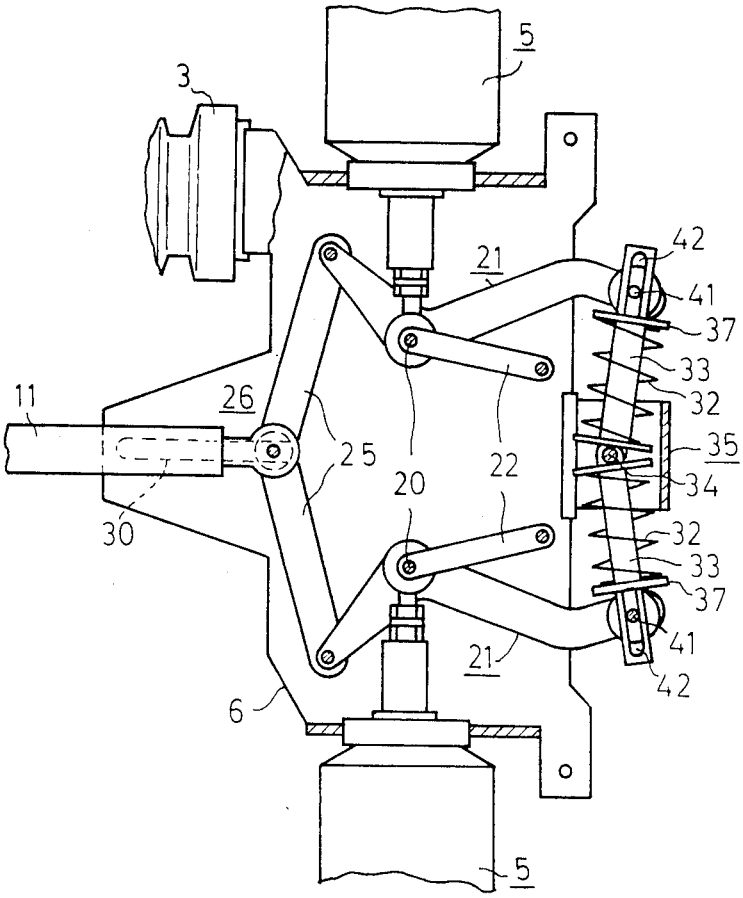

Two-armed levers 55 are designed like levers 21 shown in FIGS. 2 and 3, and accordingly transfer the motion of drive rod 11 to switching tubes 5. However, in contrast with the first embodiment, two-armed levers 55 are mounted at the ends furthest from drive rod 11 directly on support 60 and on separate bearing pins 58. This support, like support 35 (shown in FIGS. 2 to 4), is designed as a bracket with arms bent out on both sides, and is attached to pole end 6 in such a manner that after the fastening elements have been loosened it can move in the direction shown by double arrow 61 and can be fastened again in the new position. The adjustment process can be performed in a manner similar to that already described. Accordingly, drive rod 11 is separated from the drive, causing switching tubes 5 to move into the closed position under the influence of the ambient air pressure. By loosening the fastening elements of support 60, the entire mechanism consisting of springs and levers is brought into equilibrium so that both tubes 5 are activated synchronously, and after which support 60 is fastened in the neutral position.

In both the described embodiments, two-armed levers 21 and 55 respectively are bent outward in the opposite direction with regard to the points of rotation located on the drive tappets of switching tubes 5. From FIGS. 2 and 3, it can be seen that the bending is accomplished in such a manner that the ends of the respective levers are further apart from one another than the points of rotation located on the drive tappets. As a result, sufficient space is provided between them for the introduction of contact pressure springs 32 and for the connection of toggle lever system 26. Additionally, the distance between drive tappets 15 and/or eyebolts 16 inserted in them can be quite small. Two-armed levers 55 (shown in FIGS. 5 and 6) possess roughly the same design features: there is no need to make a sharper bend in the lever at the end that is closest to support casting 60. Instead, the position of arms 62 of two-armed levers 55 is chosen here so that they simultaneously take on the function of guiding levers for drive tappets 15.

There has thus been shown and described a novel vacuum circuit breaker with two switching tubes which fulfills all the objects and advantages sought therefor. Many changes, modifications, variations and other uses and applications of the subject invention will, however, become apparent to those skilled in the art after considering the specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. In a vacuum circuit breaker having two switching tubes for each pole which are electrically connected in series and arranged substantially coaxial, a drive mechanism common to both switching tubes for closing and breaking the circuit, an offsetting drive unit for producing two motions that are contrary to one another from a uniform drive motion, and a contact pressure spring assigned to each switching tube, the improvement comprising:

(a) said contact pressure springs having a common support mounted so that is can be moved along their line of action; and (b) a lever system, connected with the free end of each contact pressure spring and with said offsetting drive unit, for transmitting the force of said spring to a drive tappet of each switching tube.

2. In the vacuum circuit breaker of claim 1, in which the offsetting drive unit includes a toggle lever system with whose toggle joint is connected a drive rod that moves along its own length and whose toggle levers transmit the motion of the drive rod with a deflection of approximately 90° from the path of motion to the drive tappets of the switching tubes which face one another, the improvement wherein the lever system for each switching tube includes a two-armed lever whose point of rotation located between the ends, is placed at the drive tappet of the switching tube, and whose ends are connected by means of a joint directly or indirectly with the offsetting drive unit and with the support, respectively.

3. In the vacuum circuit breaker of claim 1, in which the offsetting drive unit is mounted on a pole end that supports the ends of the switching tubes that are nearest to the drive, the improvement wherein said common support is fastened to the pole end and has slots extending in the line of action of the contact pressure springs, through which fastening elements can be inserted, and the contact springs are mounted so as to lie in a row, substantially coaxially, between the ends of the two-armed levers that are furthest from the drive rod with the support being placed between the contact pressure springs.

4. In the vacuum circuit breaker of claim 2, in which the offsetting drive unit is mounted on a pole end that supports the ends of the switching tubes that are nearest to the drive, the improvement wherein said common support is fastened to the pole end and has slots extending in the line of action of the contact pressure springs, through which fastening elements can be inserted, and the contact springs are mounted so as to lie in a row, substantially coaxially, between the ends of the two-armed levers that are furthest from the drive rod with the support being placed between the contact pressure springs.

5. In the vacuum circuit breaker of claim 2, in which the contact pressure springs are inserted in the offsetting drive unit, the improvement wherein the contact pressure springs have one of their ends connected to the end of the two-armed lever that is closest to the drive rod, and the ends of the two-armed levers that are furthest from the drive rod are mounted with joints at separate bearings points of the support.

6. In the vacuum circuit breaker of claim 3, the improvement comprising the two-armed levers being bent out in opposite directions with respect to the points of rotation located on the drive tappets.

7. In the vacuum circuit breaker of claim 4, the improvement comprising the two-armed levers being bent out in opposite directions with respect to the points of rotation located on the drive tappets.

8. In the vacuum circuit breaker of claim 5, the improvement comprising the two-armed levers being bent out in opposite directions with respect to the points of rotation located on the drive tappets.

9. In the vacuum circuit breaker of claim 4, the improvement comprising the line connecting the points of rotation of each two-armed lever located on the support and the drive tappet, deviating only slightly from a position substantially at a right angle to the path of motion of each drive tappet.

10. In the vacuum circuit breaker of claim 5, the improvement comprising the line connecting the points of rotation of each two-armed lever located on the support and the drive tappet, deviating only slightly from a position substantially at a right angle to the path of motion of each drive tappet.

11. In the vacuum circuit breaker of claim 6, the improvement comprising the line connecting the points of rotation of each two-armed lever located on the support and the drive tappet, deviating only slightly from a position substantially at a right angle to the path of motor of each drive tappet.

12. In the vacuum circuit breaker of claim 7, the improvement comprising the line connecting the points of rotation of each two-armed lever located on the support and the drive tappet, deviating only slightly from a position substantially at a right angle to the path of motion of each drive tappet.

13. In the vacuum circuit breaker of claim 8, the improvement comprising the line connecting the points of rotation of each two-armed lever located on the support and the drive tappet, deviating only slightly from a position substantially at a right angle to the path of motion of each drive tappet.

* * * * *